US011319195B2

(12) United States Patent
Norz et al.

(10) Patent No.: US 11,319,195 B2
(45) Date of Patent: May 3, 2022

(54) FOLDABLE SUSPENDED-BALLAST GUIDE FOR A CRANE

(71) Applicant: Liebherr Werk Ehingen GmbH, Ehingen (DE)

(72) Inventors: Clemens Norz, Ehingen (DE); Hans Joachim Wenger, Ehingen (DE); Roland Bohnacker, Blaubeuren (DE); Marcus Jechle, Ulm (DE)

(73) Assignee: Liebherr Werk Ehingen GmbH, Ehingen (DE)

( * ) Notice: Subject to any disclaimer, the term of this patent is extended or adjusted under 35 U.S.C. 154(b) by 125 days.

(21) Appl. No.: 16/791,407

(22) Filed: Feb. 14, 2020

(65) Prior Publication Data

US 2020/0262687 A1 Aug. 20, 2020

(30) Foreign Application Priority Data

Feb. 19, 2019 (DE) ..... 10 2019 104 142.2

(51) Int. Cl.
*B66C 23/76* (2006.01)

(52) U.S. Cl.
CPC ..... *B66C 23/76* (2013.01)

(58) Field of Classification Search
CPC ..... B66C 23/72; B66C 23/74; B66C 23/76; B66C 23/365
See application file for complete search history.

(56) References Cited

U.S. PATENT DOCUMENTS 5,586,667 A * 12/1996 Landry ..... B66C 23/76 212/195
7,546,928 B2 * 6/2009 Pech ..... B66C 23/76 212/270
8,739,988 B2 * 6/2014 Walker ..... B66C 23/76 212/177
2019/0233261 A1 * 8/2019 Norz ..... B66C 23/76

FOREIGN PATENT DOCUMENTS

CN 108275587 A * 7/2018
CN 111252680 A * 6/2020

* cited by examiner

*Primary Examiner* — Sang K Kim
*Assistant Examiner* — Nathaniel L Adams
(74) *Attorney, Agent, or Firm* — Dilworth & Barrese, LLP

(57) ABSTRACT

The invention relates to a foldable suspended-ballast guide for a crane with suspended ballast, comprising at least two lattice pieces which are pivotally connected to each other by means of at least one swivel joint, and a swivel drive for changing the swivel angle or for changing the ballast radius, wherein the suspended-ballast guide can be arranged on the crane via the first lattice piece, characterized in that the second lattice piece comprises at least one kink joint in order to kink the second lattice piece downwards or backwards in the direction of the crane to reduce the ballast radius.

18 Claims, 6 Drawing Sheets

FOLDABLE SUSPENDED-BALLAST GUIDE FOR A CRANE

BACKGROUND OF THE INVENTION

The invention relates to a foldable suspended-ballast guide for a crane with suspended ballast, comprising at least two lattice pieces which are pivotally connected to each other by means of at least one swivel joint, and a swivel drive for changing the swivel angle between the lattice pieces or for changing the ballast radius, wherein the suspended-ballast guide can be arranged on the crane via the first lattice piece.

In generic foldable suspended-ballast guides it is known to pivotally couple two lattice pieces with each other such that depending on the swivel angle of the lattice pieces a suspended ballast held by the suspended-ballast guide can be maintained at different distances to the crane. With increasing swivel angle the outreach of the suspended-ballast guide and hence the ballast radius increases. Without any change in the ballast plates picked up, different ballast moments can thereby be introduced into the crane.

What is desirable is an adjustment range as large as possible. While the maximum swivel angle substantially depends on the dimensioning of the components, the achievable minimum swivel angle for design reasons is limited by the shape of the lattice pieces, as the lattice pieces block each other at small swivel angles. As a result, it can occur that by means of an applied ballast weight a required ballast moment cannot be achieved and therefore a cumbersome and time-consuming re-ballasting becomes necessary.

A viable solution so far has been the modification of the lattice pieces used. Here, a special U-shaped profile of one of the lattice pieces has been proposed so that at a small swivel angle the second lattice piece could be accommodated in the clearance formed between the legs of the U-profile. However, even with such a solution the minimum swivel angles to be achieved are limited.

SUMMARY OF THE INVENTION

Therefore, an alternative solution is sought, by which the minimum adjustable ballast radius can be further reduced.

This object is solved by a foldable suspended-ballast guide according to the features herein. Advantageous embodiments of the suspended-ballast guide are also the subject-matter herein.

For the generic foldable suspended-ballast guide with at least two lattice pieces connected to each other via at least one swivel joint it is proposed according to the invention to equip the second lattice piece, i.e. the lattice piece which is not arranged on the crane structure, with at least one kink joint. The second lattice piece hence comprises two sub-elements which are connected to each other by means of the at least one kink joint.

It is well known that in generic suspended-ballast guides the built-in lattice pieces are of straight design, i.e. their middle axis corresponds to a straight line. According to the invention, the second lattice piece now can deviate from this standard shape, if necessary, due to the built-in kink joint, in particular to be able to even further reduce the ballast radius with an adjusted minimum swivel angle of the two lattice pieces, in that the second lattice piece is kinked downwards or backwards in the direction of the crane body by means of the kink joint. The middle axis of the second lattice piece then presents a corresponding kink angle. Due to this particularity, the special U-shape of the lattice pieces known from the prior art can be omitted. According to an advantageous embodiment of the invention at least one kink drive is provided to adjust the kink angle of the second lattice piece. Such a kink drive can be designed for example as a cylinder, preferably in the form of a pull cylinder which is arranged on the structure of the second lattice piece in the region of the at least one kink joint and engages both sub-elements. By actuating the drive, in particular the piston rod, the kink angle obtained preferably can be steplessly adjusted.

According to a design variant of the invention, the corner posts of the second lattice piece are of split design. The sections of the corner posts then preferably are connected to each other via the built-in kink joint. Preferably, the kink joints are disposed in the region of the corner posts of the bottom chord of the second lattice piece. The corner posts of the top chord also are of split design and must be firmly connected to each other in the case of larger ballast radii, i.e. when the second lattice piece is not kinked. This connection must be separated only to adjust a very small or minimum ballast radius in order to provide for kinking of the lattice piece.

Against this background it is particularly advantageous when at least one fixing device is provided on the second lattice piece, which releasably connects the sections of the corner posts of the top chord to each other. In a preferred embodiment, the fixing device comprises at least one securing bolt for bolting the sections of at least one corner post in the top chord of the second lattice piece. Ideally, the sections of the corner posts are provided with complementary finger or fork elements at their ends.

Furthermore, it is expedient to provide the second lattice piece with a suitable bolt extracting device in order to automatically extract or insert the securing bolts of the corner posts of the top chord, if necessary.

Care should be taken, however, that the securing bolts cannot be released inadvertently. For monitoring purposes, the use of a suitable sensor system is recommendable to monitor the position of the securing bolts. For example, at least one proximity sensor is employed, which is seated on the lattice piece in the region of the securing bolt and can detect the position thereof. What is conceivable is a sensor for detecting the bolt in the inserted position and a sensor for detecting the bolt in the released position. The sensor system comprises an appropriate interface for communication with a crane controller.

As another optional and advantageous safety measure, an additional securing means is provided to secure the bolt at least in the inserted position. A mechanical solution is preferred here, which prevents an extraction of the bolt by form fit. The dimensioning of the securing means is chosen such that the same withstands the tensile force of the bolt extracting device.

According to an advantageous embodiment, the securing means can be configured in the form of a securing lug which for securing purposes engages into an axial protrusion of the bolt from the bolt receptacle and mechanically blocks the bolt from being pulled out of the bolt receptacle.

Preferably, the securing bolt including an optional bolt extracting device is mounted on the first sub-element of the second lattice piece, i.e. on that sub-element of the second lattice piece which is pivotally connected to the first lattice piece. It is particularly advantageous when exactly one securing bolt is provided per corner post of the top chord.

To provide for an automated release of the securing means, the bolt receptacle of the first and/or second sub-element of the lattice piece can be configured as an oblong hole. This provides for a certain bolt clearance and thus for a small movement of the sub-elements of the second lattice piece relative to each other also when the securing bolt is inserted. This is sufficient to displace the securing bolt within the oblong hole by the relative movement of the sub-elements and to bring it out of engagement with the securing means. A defined displacement of the bolt ideally is achieved via the kink drive of the second lattice piece. In particular, this is accomplished by pulling the sub-elements of the second lattice piece towards each other by means of the kink drive. When the kink drive is designed as a pull cylinder, the piston rod must be retracted completely to this end, so that when the corner posts are bolted, the sub-elements are slightly pressed against each other. Expediently, corresponding abutment points are to be provided at the sub-elements.

The extension by a suitable sensor system for detecting the concrete position of the securing bolt within the oblong hole is expedient with regard to a connection to a crane controller. Here as well, the use of at least one proximity sensor is found to be expedient, which is to be arranged in the vicinity of the oblong hole.

For the swivel drive of the first and second lattice pieces one or more cylinder units preferably are employed. What is preferred is the use of at least two swivel cylinders arranged parallel to each other, which engage the first lattice piece on the one hand and the second lattice piece on the other hand. Ideally, an articulation of the one or more swivel cylinders is effected in the region of the one or more kink joints of the second lattice piece.

When swivelling the first lattice piece back in the direction of the crane body, the backward movement also can be limited due to possible interfering edges of the crane body. In particular in a crane with a derrick construction, an SA trestle can represent a relevant interfering edge. In such a case, the first lattice piece might provide a sufficient clearance into which the interfering edge, in particular the SA trestle, can dip on swivelling back. An appropriate clearance is achieved for example by a C-shaped or U-shaped cross-sectional profile of the first lattice piece, wherein the clearance here is obtained between the legs of the profile.

Beside the suspended-ballast guide according to the invention the present application likewise relates to a crane, in particular a mobile crane, ideally a crawler crane with derrick boom, comprising a corresponding pivotable suspended-ballast guide. Accordingly, the same advantages and properties are obtained for the crane as they have already been explained above with reference to the suspended-ballast guide according to the invention. A repetitive description will be omitted for this reason.

BRIEF DESCRIPTION OF THE DRAWINGS

Further advantages and properties of the invention will be explained in detail below with reference to an exemplary embodiment illustrated in the Figures, in which.

DESCRIPTION OF THE PREFERRED EMBODIMENTS

The mode of operation of the foldable suspended-ballast guide according to the invention will be described with reference to the exemplary embodiment illustrated in the Figures. According to this exemplary embodiment the suspended-ballast guide is mounted on a crawler crane comprising a derrick boom. Beside the main boom, the crane comprises a derrick boom 21 which is connected to the SA trestle 20 via a guying. The assembly of the suspended-ballast guide is effected on the uppercarriage, wherein for this purpose the first lattice piece 11 of the suspended-ballast guide is pivotally articulated to the uppercarriage with its free end.

Figure 1:
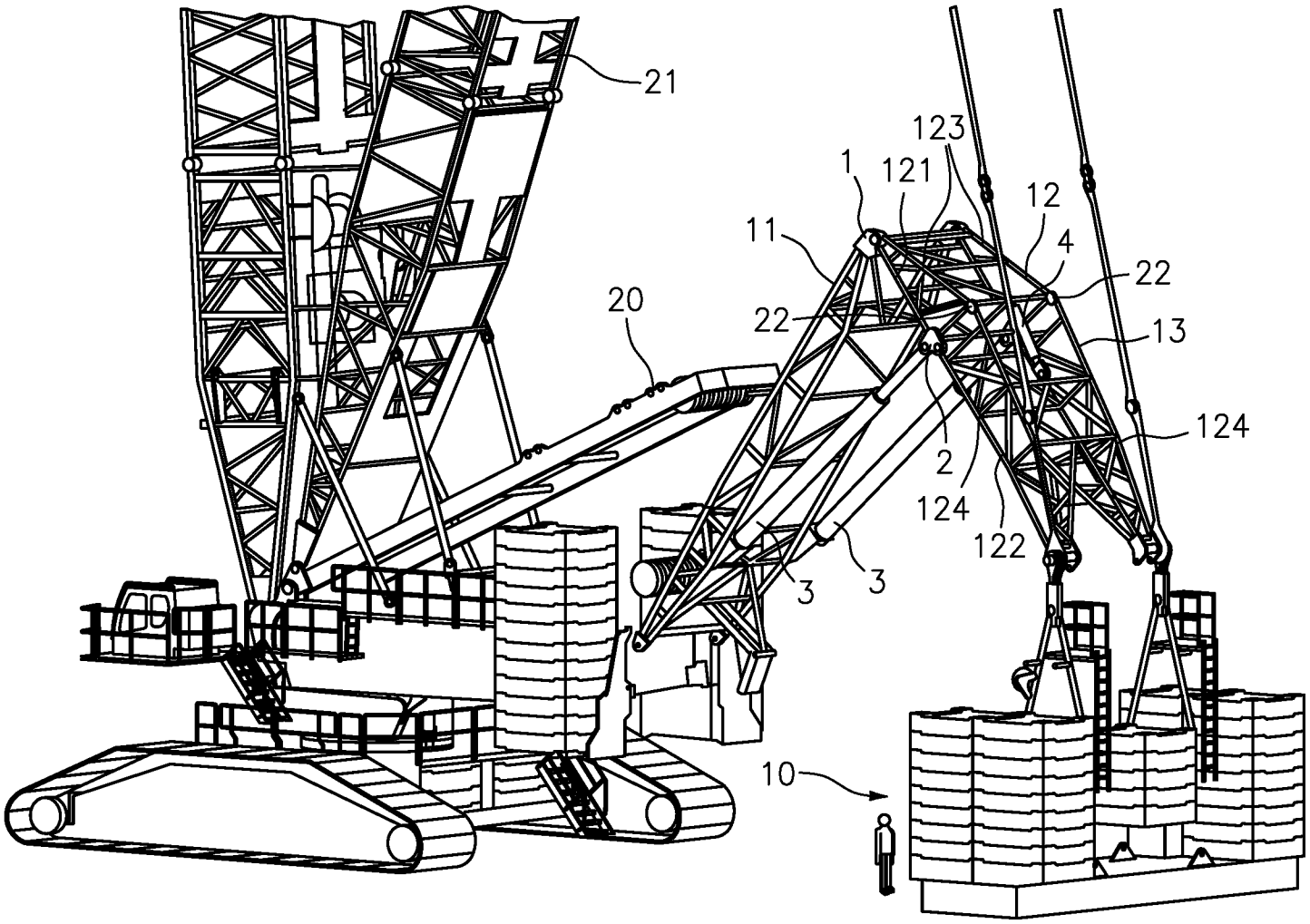
FIG. 1: shows a perspective detail view of the crane according to the invention with a mounted pivotable suspended-ballast guide.

A good overview of the structural design of the suspended-ballast guide is found in FIG. 1. The suspended-ballast guide according to the invention substantially consists of the two lattice pieces 11, 12 whose corner posts converge at the end. In the region of the converging corner posts, the lattice pieces are connected to each other via a total of two swivel joints 1. The free end of the second lattice piece 12 comprises two assembly points for accommodating a ballast pick-up frame 10. What likewise engages in the region of these assembly points is a guying which extends from the suspended-ballast guide to the tip of the derrick boom 21. By changing the swivel angle included by the two lattice pieces 11, 12, the distance of the ballast to the crane body hence can be adjusted.

A change in angle is effected by the two swivel cylinders 3 arranged in parallel. On the cylinder side, the same are attached to the first lattice piece 11 close to the assembly point on the crane uppercarriage. The piston boss is mounted on the second lattice piece 12, in particular on the kink joints 2 provided there, the purpose of which will yet be discussed in detail below.

This integral kink joint 2 is an essential part of the invention, as by the same the second lattice piece 12 can be kinked downwards or in the direction of the crane body, as required. In principle, the second lattice piece 12 consists of the two sub-elements 12*a*, 12*b* which are connected to each other via the two kink joints 2 and can be pivoted relative to each other.

Concretely, the corner posts of the second lattice piece 12 each are of two-part design, wherein the sections 121, 122 of the two lower corner posts of the bottom chord are connected to each other via a kink joint 2. Due to the built-in kink joint 2, the sub-element 12*b* connected to the ballast pick-up frame 10 can be kinked downwards or backwards in the direction of the crane body so that despite a constant swivel angle between the first and the second lattice piece 11, 12 a further reduction of the ballast radius is achieved.

Reference numeral 4 denotes a swivel cylinder and reference numeral 13 denotes a lattice piece in FIG. 1.

Figure 5C:
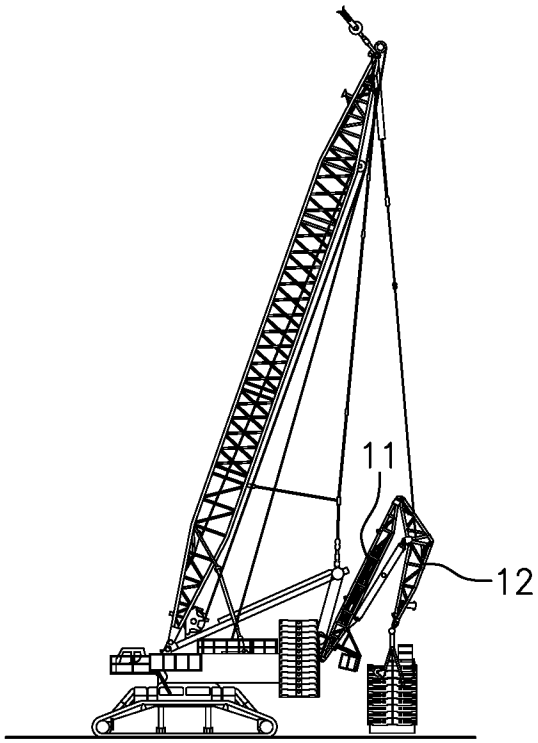
FIGS. 5A, 5B, 5C: each show three schematic side views of the crane according to the invention with differently adjusted ballast radii to illustrate the mode of operation of the suspended-ballast guide according to the invention.
Figure 5B:
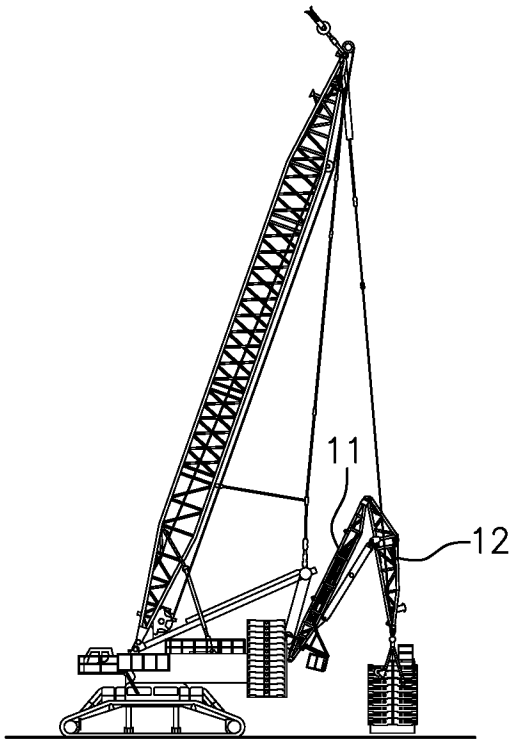
Figure 5A:
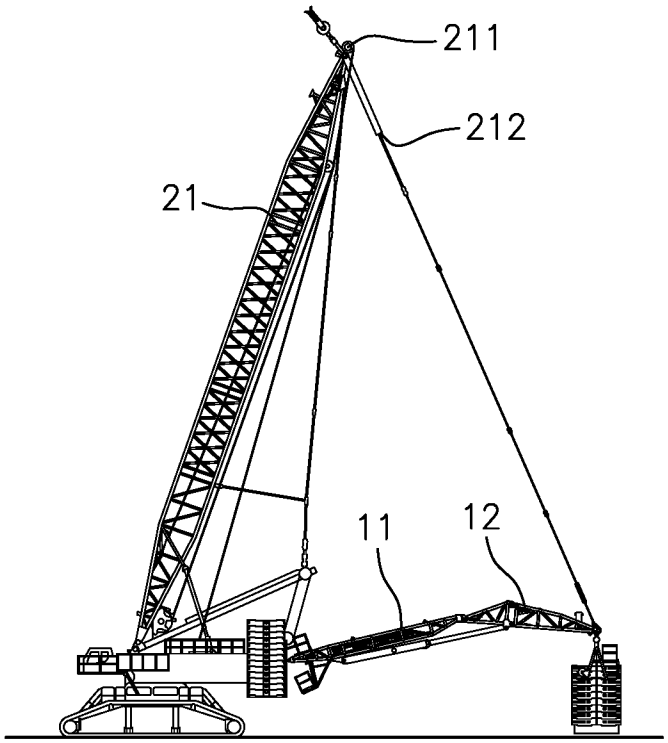
Figure 6:
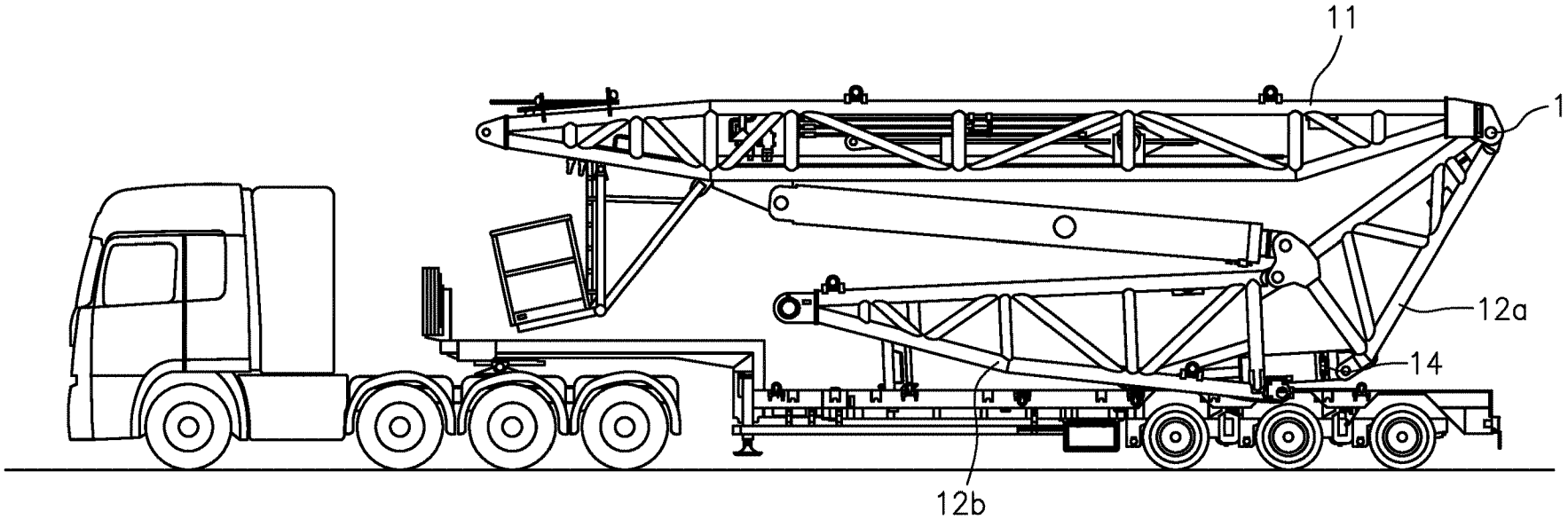
FIG. 6: shows a side view of the suspended-ballast guide according to the invention in a transport position.

The mode of operation and adjustability of the novel suspended-ballast guide is illustrated in FIGS. 5*a*-5*c*. FIG. 5*a* shows the suspended-ballast guide with fully extended swivel cylinders 3 and maximum swivel angle between the lattice pieces 11, 12, whereby the maximum ballast radius is set. The second lattice piece 12 is also not kinked. In this configuration, for example a ballast radius of about 30 m can be achieved.

In FIG. 5*b*, the swivel cylinders 3 both are retracted completely; the swivel angle between the lattice pieces accordingly is minimal. The second lattice piece 12, however, is not yet kinked. With this setting, for example, a ballast radius of about 16 m can be set in the illustrated construction. Accordingly, the ballast radius can be varied by means of the swivel cylinders 3 over a comparatively large radius area, wherein ideally a stepless adjustment is possible.

FIG. 5*c* likewise shows fully retracted swivel cylinders 3, but here the second lattice piece 12 additionally was kinked down by means of the integral kink joint 2 so that the ballast radius was further reduced as compared to FIG. 5*b*. For example, the ballast radius can again be reduced by about 3 m to 13 m by means of the kink joint 2.

Figure 2:
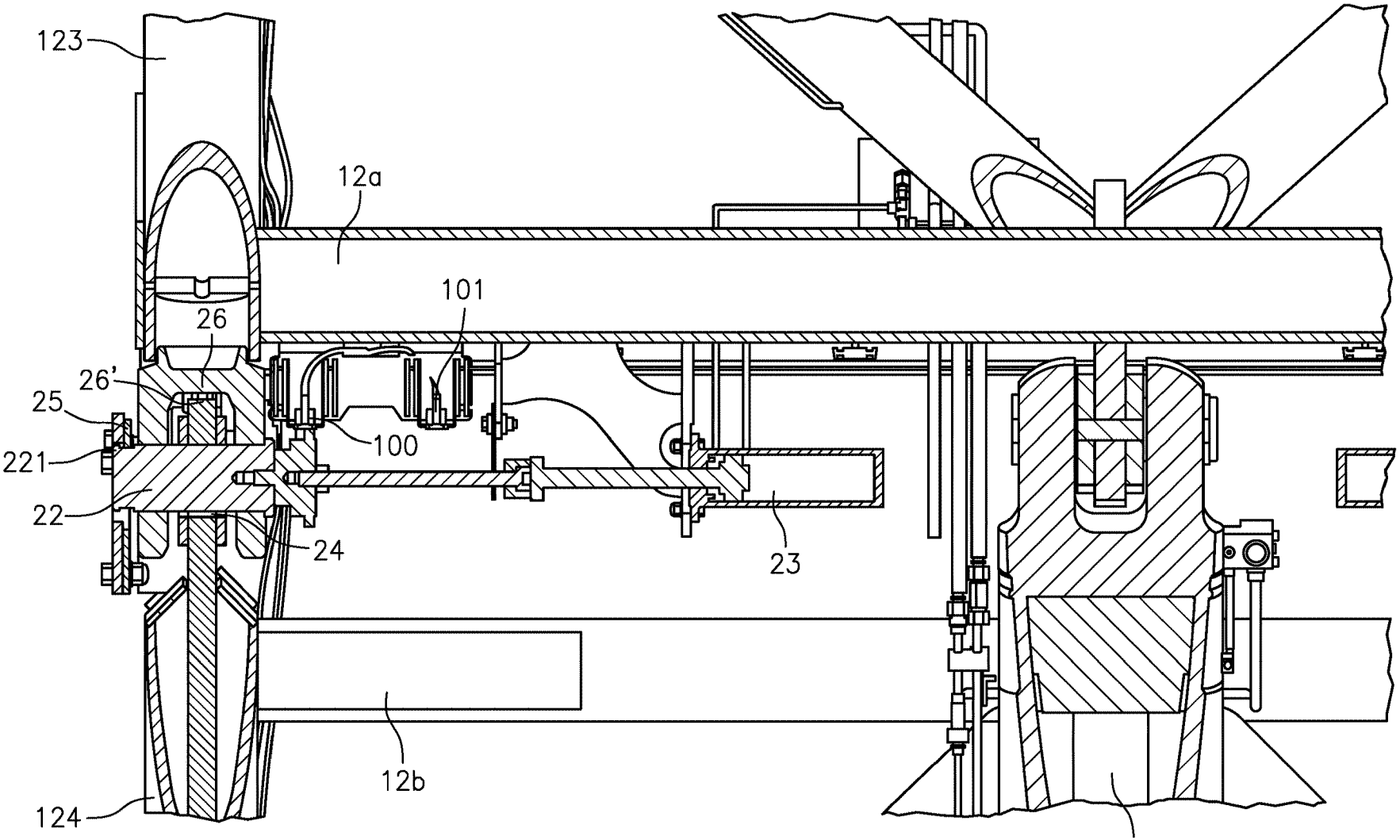
FIG. 2: shows a detail view, partially in section, of the second lattice piece in the region of the securing bolt.
Figure 3:
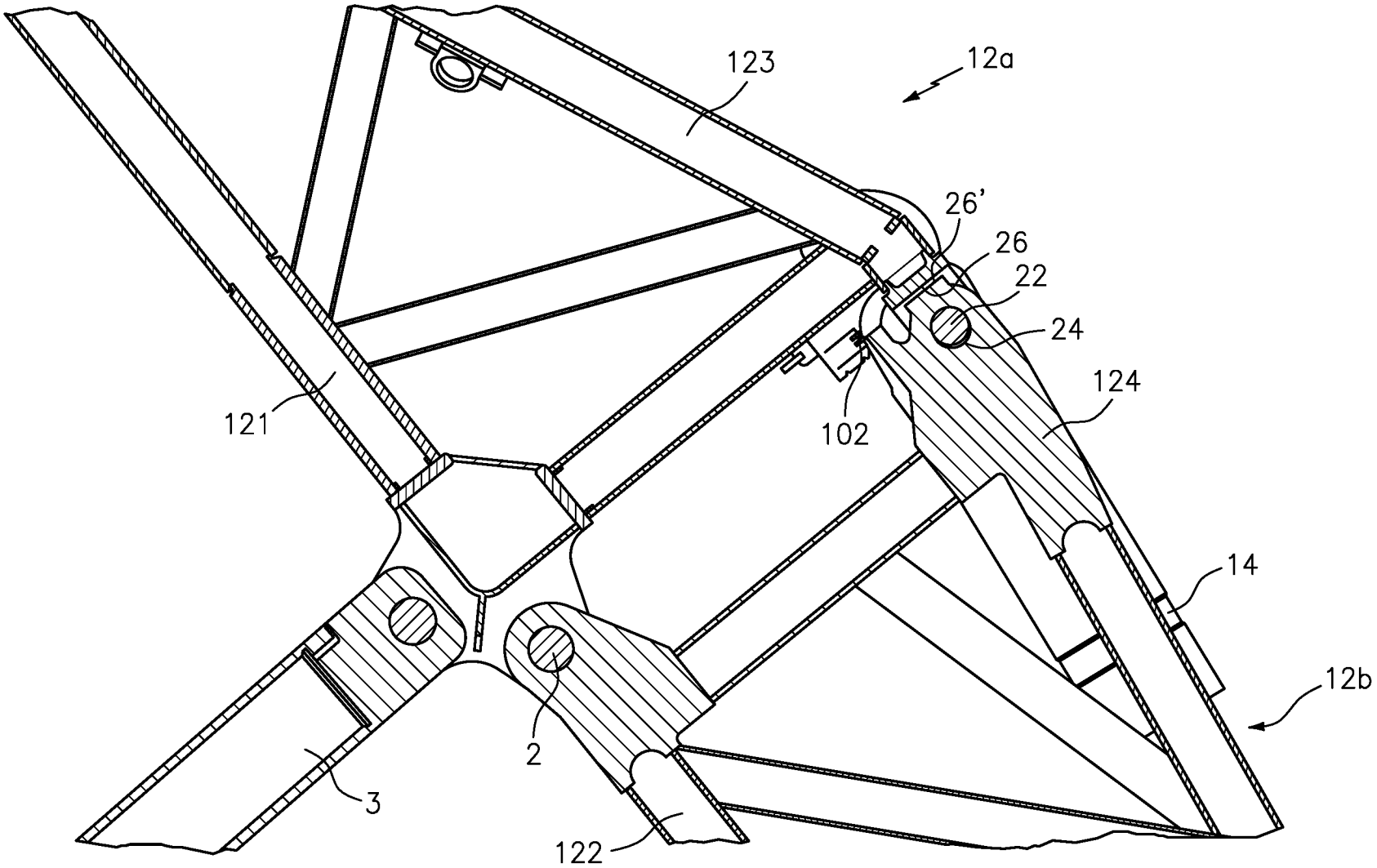
FIG. 3: shows another side view of the detail area as shown in FIG. 2, FIG. 4: shows another perspective view of the second lattice piece in the region of the kink joint.
Figure 4:
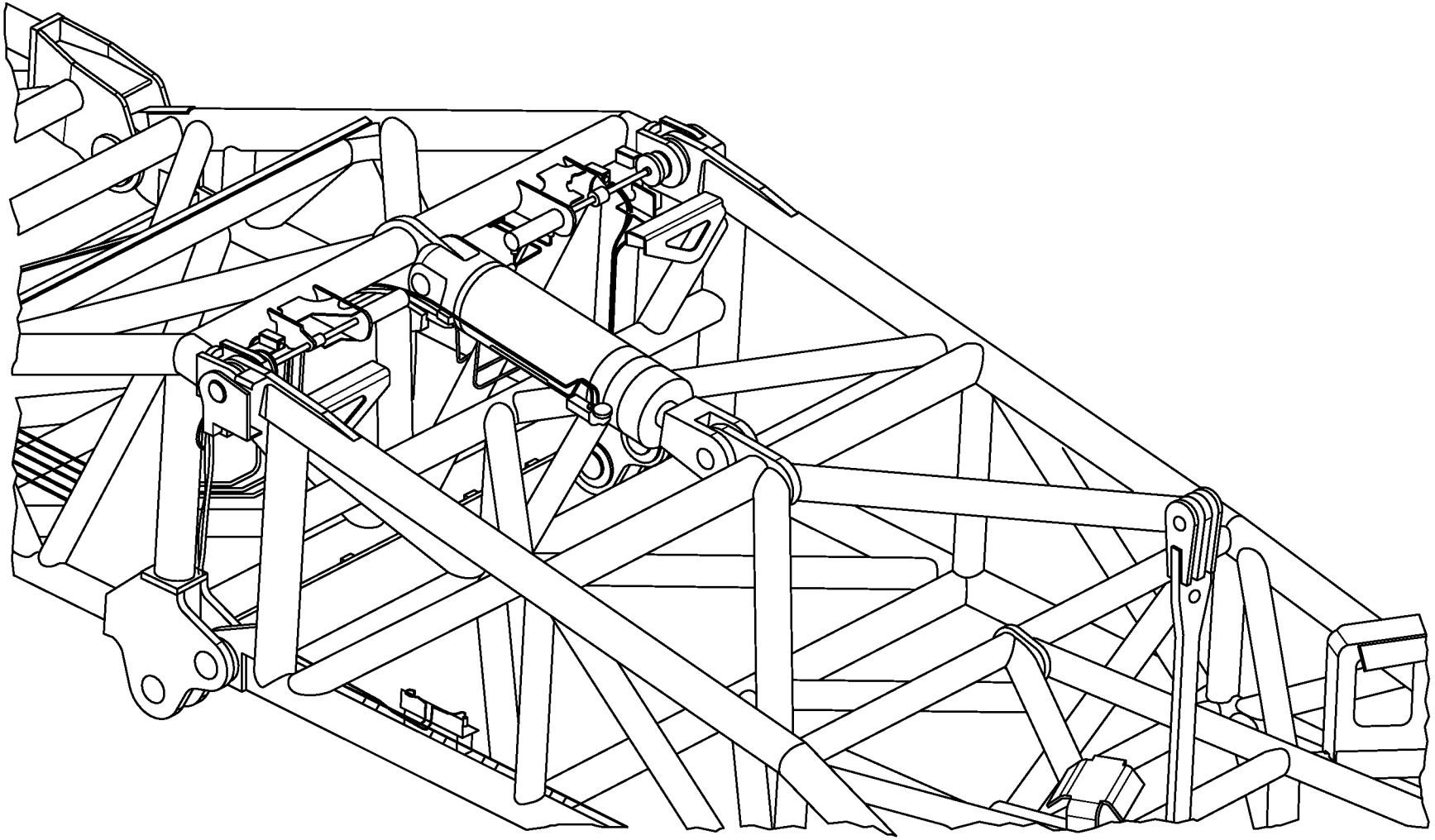

The mode of operation of the kink connection between the sub-elements 12*a*, 12*b* of the second lattice piece 12 will be explained below with reference to the detail representations of FIGS. 2 to 4. For kinking the sub-element 12*b* it is necessary to release the connection between the sections 123, 124 of the two upper corner posts, as otherwise a kinking movement would be blocked. In the radius area as shown in FIGS. 5*a*, 5*b* a loadable and secure connection between the sections 123, 124 must be guaranteed instead. The required releasable connection between the sections 123, 124 of the two upper corner posts is achieved by bolting each by means of a securing bolt 22 which not only can be extracted/inserted by a machine, but in addition is secured against an unwanted actuation by means of a securing mechanism.

The upper corner posts 123, 124 of the sub-elements 12*a*, 12*b* of the lattice piece 12 include a complementary fork-finger connection which for each pair of corner posts in the upper chord can be created or released by an associated securing bolt 22. The fork/finger element in principle can arbitrarily be distributed over the sub-elements 12*a*, 12*b*, and here the fork elements are arranged on the corner posts 123 of the sub-element 12*a*. The securing bolts 22 for each pair of corner posts likewise are mounted on the sub-element 12*a* together with a controlled bolt drawing device 23. By means of the bolt extracting device, the securing bolt 22 can be shifted in an axial direction and be inserted into or pulled out of the bores of the fork-finger combination. The proximity sensors 100, 101 serve to detect the position of the securing bolt 22, wherein the proximity sensor 100 mounted closer to the fork-finger combination detects the bolt 22 in the inserted position, while the sensor 101 mounted closer to the lattice piece center detects an extracted bolt 22.

A protrusion 22*a* of the securing bolt 22 protrudes from the bore of the fork-finger combination on the outside of the lattice piece 12. In the illustrated bolt position, a securing lug 25 mounted on the sub-element 12*b* radially engages into the protrusion 221 and thus mechanically blocks the bolt 22 against being pulled out by the bolt extracting device 23. Only when the securing lug 25 is brought out of engagement with the protrusion 221 of the bolt 22, the same can be extracted and the connection of the corner posts in the top chord of the lattice piece 12 can be opened.

To provide for a machine-controlled release of the securing lug 25, the bore of the finger element at the corner post 124 of the sub-element 12*b* is configured as an oblong hole 24, which permits a certain bolt clearance and provides for a small movement of the sub-element 12*b* relative to the sub-element 12*a* also with an inserted securing bolt. By means of the kink drive 14, here in the form of a pull cylinder, which on the cylinder side is centrally mounted on a connecting rod of the top chord of the sub-element 12*a* and on the piston side is centrally mounted on a connecting rod of the top chord of the sub-element 12*b*, the sub-element 12*b* can be pulled a small distance in the direction of the sub-element 12*a* also when the bolt 22 is inserted, until the bolt 22 abuts against the wall of the oblong hole 24 and the two abutment points 26, 26' of the fork-finger combination are pressed against each other. This small relative movement is enough to bring the securing lug 25 mounted on the sub-element 12*b* out of engagement with the protrusion 221 and to thereby eliminate the mechanical blockage. The bolt 22 can now be extracted.

A proximity sensor 102 arranged in the region of the two abutment points 26, 26' monitors and detects the distance of the two sub-elements 12*a*, 12*b* to each other in order to thereby detect the securing state of the bolt 22.

The pull cylinder 14 not only serves to release the securing lug 25, but generally to steplessly adjust the kink angle between the sub-elements 12*a*, 12*b* of the second lattice piece 12.

An essential point also is the control of the extending and retracting movements of the suspended ballast at a constant speed. In doing so, a precise actuation of all three cylinders, i.e. of both the swivel cylinders 3 and the pull cylinder 14, must be ensured. In particular, the concrete geometrical conditions of the suspended-ballast guide must be taken into account. The height of the suspended ballast plate can be kept constant while changing the ballast radius. On retraction and extension of the suspended ballast, the suspended ballast would perform a circular movement around the derrick head 211. The ballast pull cylinders 212 in the guying between derrick boom 21 and suspended-ballast guide are controlled correspondingly and can keep the ballast plate at a constant height.

By using the two joints, i.e. on the one hand the swivel joint 1 and the kink joints 2, a compact transport unit comprising the two lattice pieces 11, 12 and the respective cylinders 3, 14 can be produced, which does not require an expensive disassembly of components. Instead, due to the swivelling and kinking kinematics, the transport window available in public road traffic can be utilized efficiently. In total, this considerably reduces the assembly and transport expenditure.

The invention claimed is:

1. A foldable suspended-ballast guide for a crane with suspended ballast, comprising at least two lattice pieces which are pivotally connected to each other by at least one swivel joint, and a swivel drive for changing a swivel angle or a ballast radius, wherein the suspended-ballast guide is arranged on the crane via a first lattice piece, a second lattice piece comprises at least one kink joint to kink the second lattice piece downwards or backwards in the direction of the crane to reduce the ballast radius, and at least one kink drive for adjusting a kink angle is arranged on the second lattice piece.

2. The foldable suspended-ballast guide according to claim 1, wherein corner posts of the second lattice piece are split and sub-elements of the corner posts of a bottom chord are connected to each other via a respective kink joint.

3. The foldable suspended-ballast guide according to claim 1, wherein the swivel drive acts in the region of the one or more kink joints of the second lattice piece.

4. The foldable suspended-ballast guide according to claim 3, wherein the swivel drive comprises two cylinders aligned parallel to each other.

5. The foldable suspended-ballast guide according to claim 1, wherein the first lattice piece is pivotally arranged on a crane body, and has a U-shaped or C-shaped cross-sectional profile, so that when pivoting the first lattice piece back in the direction of the crane body, a crane component at least partly penetrates into a clearance formed between legs of a profile of the first lattice piece.

6. The foldable suspended-ballast guide according to claim 5, wherein the crane component is an SA trestle of the crane.

7. A crane comprising at least one foldable suspended-ballast guide according to claim 1.

8. The foldable suspended-ballast guide according to claim 1, wherein the at least one kink drive is in the form of a pull cylinder whose rod movement effects a change of the kink angle of sub-elements of the second lattice piece.

9. A foldable suspended-ballast guide for a crane with suspended ballast, comprising at least two lattice pieces which are pivotally connected to each other by at least one swivel joint, and a swivel drive for changing a swivel angle or a ballast radius, wherein the suspended-ballast guide is arranged on the crane via a first lattice piece, a second lattice piece comprises at least one kink joint to kink the second lattice piece downwards or backwards in the direction of the crane to reduce the ballast radius, corner posts of the second lattice piece are split and sub-elements of the corner posts of a bottom chord are connected to each other via a respective kink joint, and the sub-elements of the second lattice piece are releasably connectable to each other by a fixing device in the region of a top chord of the second lattice piece.

10. The foldable suspended-ballast guide according to claim 9, wherein sections of the corner posts of the top chord are releasably connectable to each other.

11. A foldable suspended-ballast guide for a crane with suspended ballast, comprising at least two lattice pieces which are pivotally connected to each other by at least one swivel joint, and a swivel drive for changing a swivel angle or a ballast radius, wherein the suspended-ballast guide is arranged on the crane via a first lattice piece, a second lattice piece comprises at least one kink joint to kink the second lattice piece downwards or backwards in the direction of the crane to reduce the ballast radius, corner posts of the second lattice piece are split and sub-elements of the corner posts of a bottom chord are connected to each other via a respective kink joint, and a fixing device provides at least one securing bolt for bolting sections of the corner posts and a bolt extracting device.

12. The foldable suspended-ballast guide according to claim 11, wherein a securing lug is arranged to engage into an axial protrusion of the at least one securing bolt.

13. The foldable suspended-ballast guide according to claim 12, wherein a bolt receptacle bolt receptacle of the at least one securing bolt is designed as an oblong hole, such that by shifting the at least one securing bolt within the oblong hole, the securing lug can be brought out of engagement with the at least one securing bolt.

14. The foldable suspended-ballast guide according to claim 11, wherein at least one securing bolt per corner post is provided.

15. The foldable suspended-ballast guide according to claim 11, wherein a the bolt receptacle of the at least one securing bolt is designed as an oblong hole.

16. The foldable suspended-ballast guide according to claim 15, wherein shifting the securing bolt is effected by a kink drive.

17. The foldable suspended-ballast guide according to claim 16, wherein the shifting of the securing bolt is effected by pulling the sub-elements of the second lattice piece towards each other, and points of abutment against a contact area of the sub-elements are provided.

18. The foldable suspended-ballast guide according to claim 15, wherein at least one proximity sensor is placed in the region of the fixing device or the oblong hole to detect the position of the at least one securing bolt within the oblong hole.

* * * * *